US005819717A

United States Patent [19]

Johnson et al.

[11] Patent Number: 5,819,717

[45] Date of Patent: Oct. 13, 1998

[54] LAUNCHER FOR A TOY PROJECTILE OR SIMILAR LAUNCHABLE OBJECT

[75] Inventors: Lonnie G. Johnson, Smyrna; John T. Applewhite, Atlanta, both of Ga.

[73] Assignee: Johnson Research and Development Company, Inc.

[21] Appl. No.: 874,049

[22] Filed: Jun. 12, 1997

[51] Int. Cl.[6] ..... F41B 11/00

[52] U.S. Cl. ..... 124/65; 124/56; 124/63; 124/66

[58] Field of Search ..... 124/65, 56, 63, 124/64, 66, 71, 73, 76

[56] References Cited

U.S. PATENT DOCUMENTS

| | | | |
|---|---|---|---|
| 5,333,594 | 8/1994 | Robinson | 124/56 |
| 5,398,873 | 3/1995 | Johnson et al. | 239/99 |
| 5,499,940 | 3/1996 | Johnson et al. | 446/180 |
| 5,535,729 | 7/1996 | Griffin et al. | 124/65 |
| 5,553,598 | 9/1996 | Johnson et al. | 124/63 |
| 5,596,978 | 1/1997 | Johnson et al. | 124/63 |
| 5,613,483 | 3/1997 | Lukas et al. | 124/73 |
| 5,701,878 | 12/1997 | Moore et al. | 124/66 |

*Primary Examiner*—Charles T. Jordan
*Assistant Examiner*—Theresa M. Wesson
*Attorney, Agent, or Firm*—Michael Drew

[57] ABSTRACT

A launching chamber (20) with an exhaust orifice (32) covered by an obstruction member (34, 36) is in fluid-pressure dependent mechanical communication with an equilibrium chamber (40) such that when the two chambers are in fluid pressure equilibrium and fluid pressure in the equilibrium chamber is decreased to a predetermined amount less than the fluid pressure in the launching chamber the obstruction member uncovers the exhaust orifice. The equilibrium chamber (40) is vented through a turbine tube (70) which drives a turbine wheel (72).

12 Claims, 4 Drawing Sheets

LAUNCHER FOR A TOY PROJECTILE OR SIMILAR LAUNCHABLE OBJECT

TECHNICAL FIELD OF THE INVENTION

The present invention relates to launchers for projectiles, and more particularly to a launcher that utilizes pressurized fluid to launch a toy projectile or similar launchable object and provide a sound effect or other event that accompanies launch.

BACKGROUND OF THE INVENTION

Projectiles are useful for entertainment as well as educational purposes. Thus, it can be appreciated that it would be useful to have a means for launching a projectile that would enhance the entertainment and/or educational benefits thereof. The entertainment and/or educational benefits of a toy or other object may be enhanced by providing an effect which occurs simultaneously with or in close approximation with launching of the object.

SUMMARY OF THE INVENTION

In the present invention, a launching chamber with an exhaust orifice covered by an obstruction member is in fluid-pressure dependent mechanical communication with an equilibrium chamber such that when the two chambers are in fluid pressure equilibrium and fluid pressure in the equilibrium chamber is decreased to a predetermined amount less than the fluid pressure in the launching chamber the obstruction member uncovers the exhaust orifice. The equilibrium chamber is vented through a turbine tube which drives a turbine wheel.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 1:
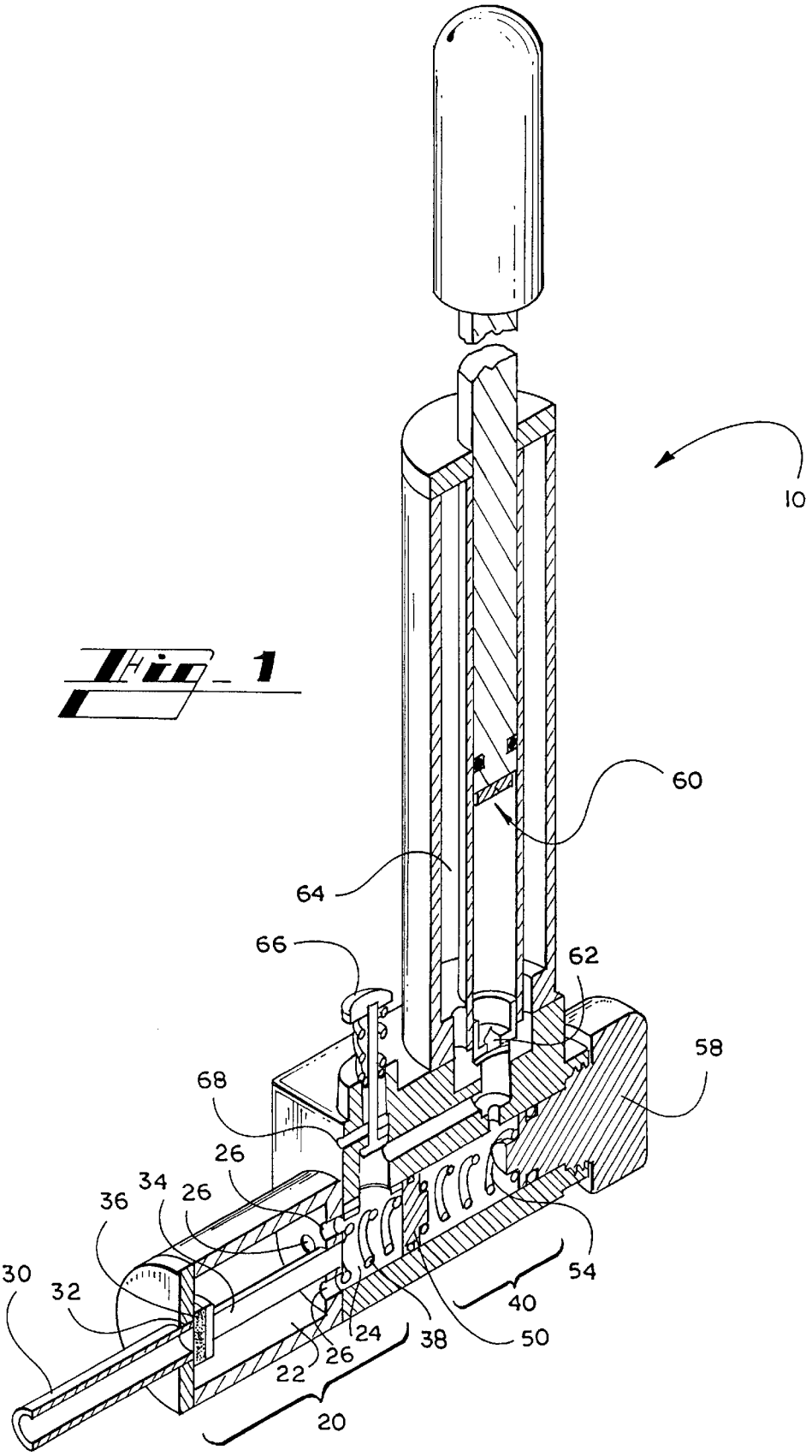
FIG. 1 is a cut-away isometric illustration of launcher for toy projectiles or similar impaleable objects according to a preferred embodiment of the invention.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to refer to identical features.

As a general overview, the invention utilizes a fluid such as a gas (for example, air) or liquid (for example, water) to launch a projectile such as toy car or rocket. The invention places the fluid under pressure and then releases the fluid through two conduits in an automatic sequence. The fluid is released through the two conduits in a manner such that a first fluid flow initiates a desired effect, such as the turning of a turbine wheel for a sound effect, and the second fluid flow is automatically initiated after commencement of the first fluid flow to launch the object.

Figure 2:
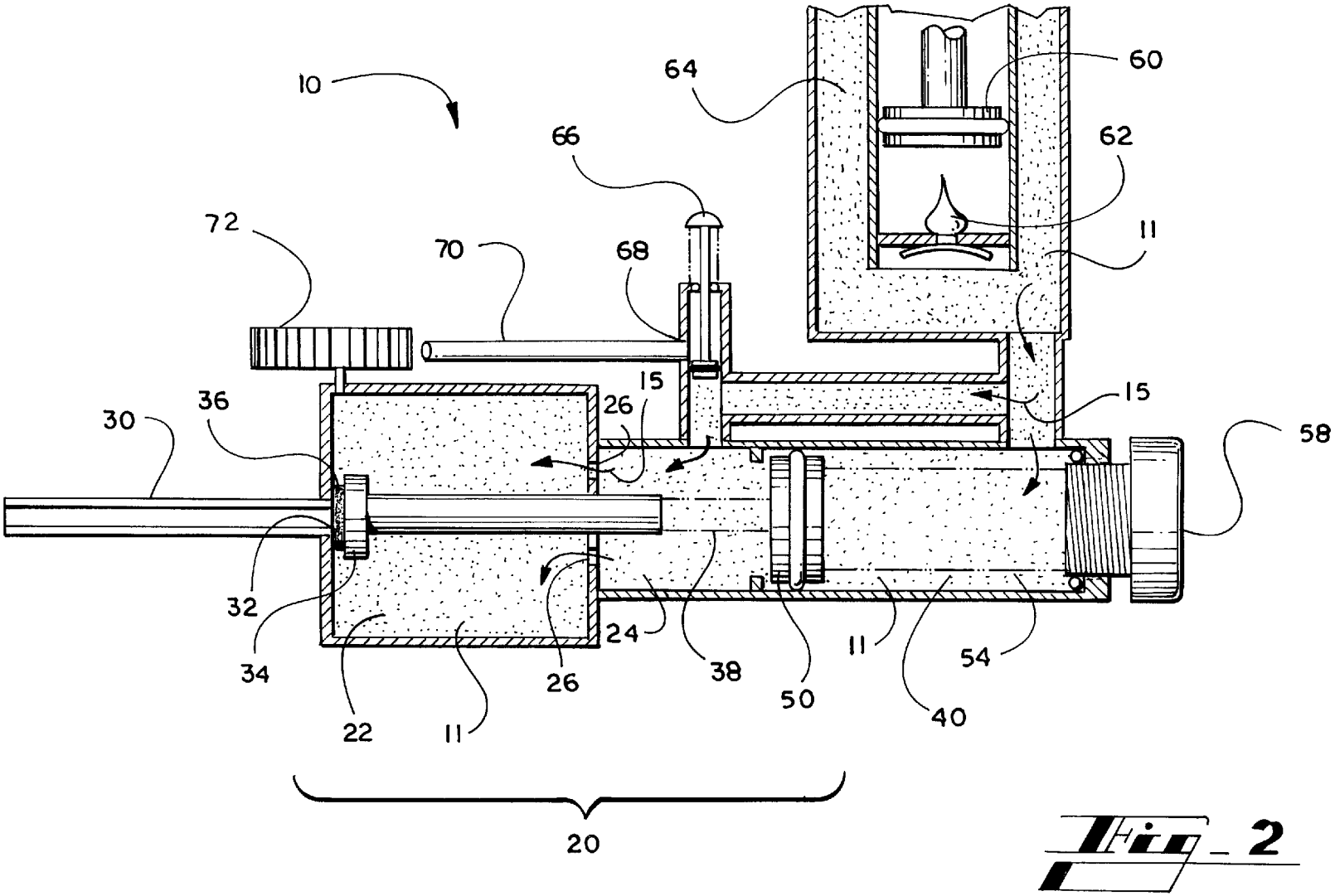
FIG. 2 is a schematic representation of the invention of FIG. 1 as the launching and equilibrium chambers are pressurized.

Referring first to FIG. 1, therein is illustrated a launcher 7, and system for launching, toy projectiles or similar impaleable objects according to a preferred embodiment of the invention. The invention may be best understood by simultaneous reference to a combination of figures. Referring now to FIG. 1 and FIG. 2, the elements and initial operation of the invention will be discussed. Two chambers are in volume-changing contact with one another. That is, a first chamber, for convenience of reference called a launching chamber 20, is adjacent a second chamber, which for convenience of reference is called an equilibrium chamber 40. The launching chamber 20 may for convenience be considered as having a first, or anterior, compartment 22, and a second, or posterior, compartment 24, which are divided by a partition having apertures 26 extending therethrough to permit the free flow of fluid between the two. A launching tube 30 upon which an object such as a toy vehicle is positioned is affixed adjacent the exhaust orifice 32 of the launching chamber 20. The toy vehicle or similar launchable object is positioned upon or adjacent the launching tube 30 so as to receive a burst of fluid exiting the tube 30. A piston-like obstructor 34 (for convenience of reference referred to as an "obstructor piston") having a compressible head 36 is translatable between positions wherein the exhaust orifice 32 is blocked and unobstructed. The volumes of the launching 20 and equilibrium 40 chambers are related to one another by a reciprocally translatable piston member 50 located between the two chambers. The piston 50 may be referred to as an equilibrium piston for convenience. It is suitably sealed by an O-ring as shown. Stop members 52 set the forwardmost position of the equilibrium piston 50. In this forwardmost piston 50 position the volume of the launching chamber 20 is minimized and the volume of the equilibrium chamber 40 is at its maximum. As the piston translates rearwardly the volume of the launching chamber 20 increases and the volume of the equilibrium chamber 40 decreases. The equilibrium piston 50 is biased in a forwardmost position by a first biasing member 54. In the preferred embodiment illustrated the first biasing member 54 is a helical spring. An example of another suitable biasing means is a bladder. The tension of the biasing member is adjustable through the screw mechanism 58 illustrated which defines the position of the rear end of the first helical spring 54. The equilibrium piston 50 and obstructor piston 34 are attached to one another. Although the two may be directly attached the objectives of the invention are more suitably achieved (as will be explained in greater detail below) when the two are connected by a second biasing member 38 in the form of a second helical spring. The second biasing member/spring biases the obstructor piston 34 and equilibrium piston 50 in proximity to one another. Thus, the two pistons 34, 50 move in conjunction with one another.

The launching 20 and equilibrium 40 chambers of the preferred embodiment of the invention are pressurized with fluid by a pressurizing mechanism which includes a pump with plunger 60, a check valve 62 for sustaining pressurized fluid and a supply chamber 64 for the pressurized fluid 11. Fluid flows by conventional mechanical means through the various conduits shown in the drawings. The equilibrium chamber 40, as well as the supply chamber 64, is vented through a port 68 controlled by a spring-loaded valve 66. Fluid flows from the port 68 through a conduit 70, which in the preferred embodiment illustrated serves as a turbine tube to drive the turbine wheel 72. Throughout the figures the numeral "11" denotes fluid under pressure, the numeral "13" denotes fluid that is either un-pressurized or that is undergoing de-pressurization, and the numeral "15" denotes the arrows indicating the direction of fluid flow.

Operation of the launcher and system will be described with reference primarily to the schematic illustrations of FIGS. 2 through 4. Referring first to FIG. 2, the invention is illustrated as fluid 11 is forced into the launching 20 and equilibrium chambers 40 under pressure. As discussed above, the equilibrium piston spring 54 biases the equilibrium piston 50 in a forward position which in turn helps position the obstructor piston 34 with its head 36 at the exhaust orifice 32. Direction of fluid flow is illustrated by the direction arrows 15. As the launching 20 and equilibrium chambers become pressurized with fluid a condition of equilibrium is achieved due to the unobstructed access to and communication among all three 20, 40, 64 chambers. Fluid pressure in the launching chamber 20 helps maintain the head 36 of the obstructor piston 34 positioned over the exhaust orifice 32. In fluid equilibrium the equilibrium piston 50, pre-positioned by the equilibrium spring 54, assumes a particular position.

Figure 3:
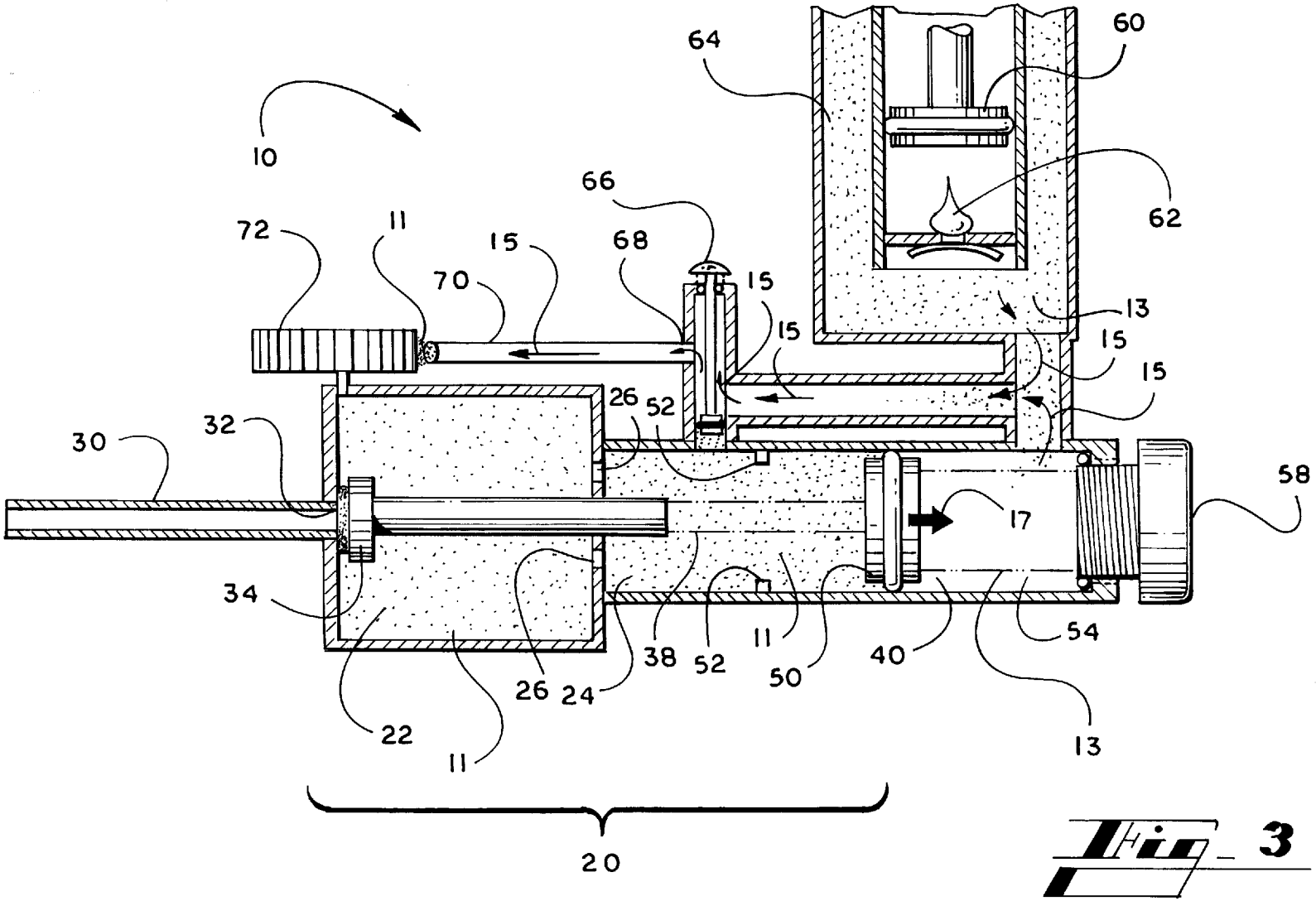
FIG. 3 is a schematic representation of the invention of FIG. 1 as the equilibrium chamber is de-pressurized.

Now referring to FIG. 3, as the vent valve 66 is opened the equilibrium 40 (and supply 64) chambers are vented through the turbine tube 70. Fluid under pressure 11 impinges the vanes of the turbine wheel 72 causing the wheel to spin rapidly. As is characteristic of turbine wheels, as the wheel 72 spins a high-pitched sound is generated thereby. This sound provides a perceivable effect. As pressure in the equilibrium chamber 40 is decreased to a condition of reduced pressure fluid 13 the higher pressure 11 in the launching chamber causes the equilibrium piston 50 to move rearwardly as indicated by the direction arrow denoted 17. The pressure 11 in the launching chamber 20 continues to hold the obstructor piston 34 in place. The interaction of the two pistons 34, 50 causes the second spring 38 to be placed in tension as it attempts to pull the two pistons back together.

Figure 4:
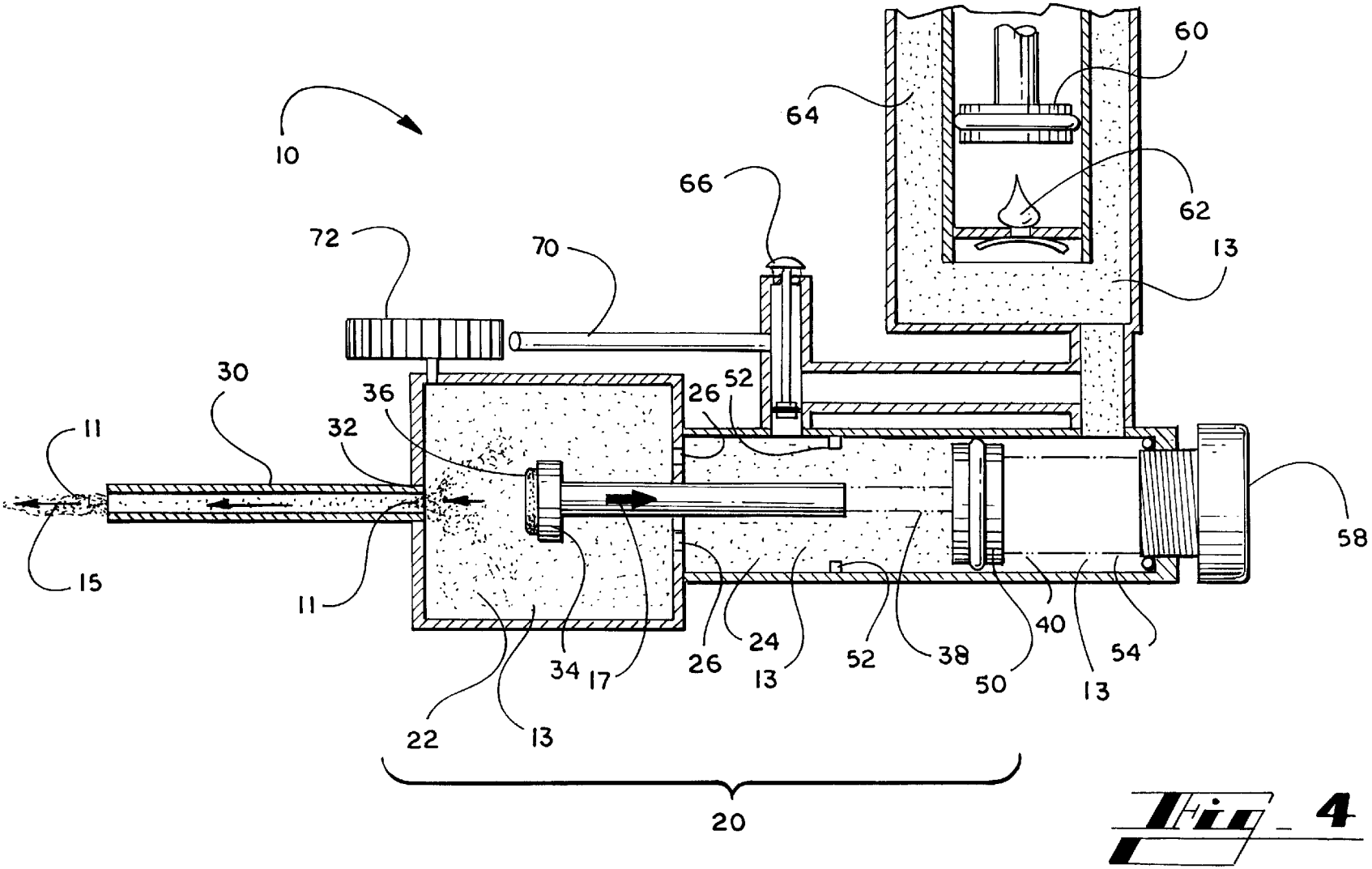
FIG. 4 is a schematic representation of the invention of FIG. 1 as the launching chamber is de-pressurized.

Referring now to FIG. 4, as the equilibrium chamber 40 becomes sufficiently less pressurized than the launching chamber 20 the tension force in the second biasing member (spring) becomes greater than the force of pressurized fluid 11 in the launching chamber 20 to pull the obstructor piston 34 rearward as indicated by the direction arrow 17. When the exhaust orifice 32 is uncovered a burst of pressurized fluid 11 escapes and launches the vehicle 19 or other closely-positioned object.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. A launcher for a toy projectile or similar launchable object comprising:

a launching chamber having an exhaust orifice and a first fluid-flow mechanism for receiving fluid into said launching chamber;

an obstruction member having a head portion, said obstruction member in mechanical communication with said launching chamber such that said head portion is reciprocally positionable over said exhaust orifice;

an equilibrium chamber having a second mechanism for fluid communication therewith, said equilibrium chamber in pressure-depending variable mechanical communication with said launching chamber and said obstruction member such that when said launching chamber and said equilibrium chamber are placed in a condition of fluid pressure equilibrium through application of fluid under pressure to said first fluid-flow mechanism and said second fluid-flow mechanism said head of said obstruction member obstructs said exhaust orifice of said launching chamber and then when the fluid pressure in said equilibrium chamber is decreased to a predetermined amount said head of said obstruction member uncovers said exhaust orifice; and a vent mechanism in selective fluid-flow communication with said second fluid-flow mechanism so that said equilibrium chamber may be vented therethrough.

2. The launcher of claim 1, said vent mechanism including a valve mechanism for selectively venting said equilibrium chamber through said vent mechanism.

3. The launcher of claim 1, further comprising a fluid pressurization mechanism in fluid communication with said first fluid-flow mechanism and said second fluid-flow mechanism for pressurizing said launching chamber and said equilibrium chamber with the fluid.

4. The launcher of claim 1, further comprising a turbine tube for receiving fluid flow from said vent mechanism.

5. The launcher of claim 4, further comprising a turbine wheel having vanes disposed for receiving the fluid flow from said turbine tube.

6. The launcher of claim 1, wherein said equilibrium chamber is in pressure-depending variable mechanical communication with said launching chamber and said obstruction member by means of a first piston member reciprocally translatably interposed between said launching chamber and said equilibrium chamber and having said obstruction member affixed thereto such that when said first piston member is in a forwardmost position said head portion of said obstruction member is positioned over said exhaust orifice and when said launching chamber and said equilibrium chamber are pressurized in a condition of fluid pressure equilibrium and the fluid pressure in said equilibrium chamber is decreased to said predetermined amount said head of said obstruction member uncovers said exhaust orifice.

7. The launcher of claim 6, further comprising a first biasing member biasing said first piston member in a forwardmost position.

8. The launcher of claim 7, wherein a degree of biasing pressure applied by said first biasing member is adjustable.

9. The launcher of claim 6, wherein said obstruction member is a second piston member.

10. The launcher of claim 6, wherein said obstruction member is attached to said first piston member by a second biasing member which biases said obstruction member proximate said first piston member.

11. The launcher of claim 6, wherein said obstruction member is a second piston member attached to said first piston member by a second biasing member which biases said second piston member proximate said first piston member.

12. The launcher of claim 1, further comprising a launching tube in fluid flow communication with said exhaust port adapted for directing said fluid exhausted from said launching chamber against the toy projectile or similar launchable object.

* * * * *